US007078633B2

(12) United States Patent
Ihalainen

(10) Patent No.: US 7,078,633 B2
(45) Date of Patent: Jul. 18, 2006

(54) DIGITAL MULTIDIRECTIONAL CONTROL SWITCH

(75) Inventor: Petri Ihalainen, Tampere (FI)

(73) Assignee: Nokia Corporation, Espoo (FI)

( * ) Notice: Subject to any disclaimer, the term of this patent is extended or adjusted under 35 U.S.C. 154(b) by 103 days.

(21) Appl. No.: 10/865,485

(22) Filed: Jun. 10, 2004

(65) Prior Publication Data

US 2004/0262142 A1 Dec. 30, 2004

(30) Foreign Application Priority Data

Jun. 18, 2003 (FI) ..... 20035099

(51) Int. Cl.
*H01H 19/00* (2006.01)

(52) U.S. Cl. ..... 200/6 A; 200/4

(58) Field of Classification Search ..... 200/4, 200/5 R, 6 A, 17 R, 18, 339; 345/157, 161; 463/36–38
See application file for complete search history.

(56) References Cited

U.S. PATENT DOCUMENTS

| | | | | |
|---|---|---|---|---|
| 5,536,911 | A | 7/1996 | Madill | |
| 5,689,285 | A * | 11/1997 | Asher | 345/161 |
| 6,348,664 | B1 | 2/2002 | Kozuma | |
| 6,359,243 | B1 | 3/2002 | Nakade et al. | |
| 6,437,682 | B1 * | 8/2002 | Vance | 338/185 |
| 6,567,074 | B1 * | 5/2003 | Numata et al. | 345/169 |
| 6,580,039 | B1 * | 6/2003 | Nakade et al. | 200/6 A |
| 6,750,408 | B1 * | 6/2004 | Inoue et al. | 200/6 A |
| 6,791,037 | B1 * | 9/2004 | Ling | 200/4 |
| 6,794,982 | B1 * | 9/2004 | Inoue et al. | 338/47 |
| 6,831,238 | B1 * | 12/2004 | Lau | 200/6 A |
| 6,841,743 | B1 * | 1/2005 | Okada et al. | 200/6 A |

FOREIGN PATENT DOCUMENTS

| | | | |
|---|---|---|---|
| EP | 1280173 | | 1/2003 |
| JP | 2004178813 A | * | 6/2004 |

* cited by examiner

*Primary Examiner*—Michael Friedhofer
*Assistant Examiner*—Lisa Klaus

(57) ABSTRACT

A multidirectional control switch which comprises at least a control means (1) arranged to be movable, a base (2), and first and second contact means in connection with the control means (1) and/or the base (2), one of the contact means being a coupling means (4). One of said contact means is a contact surface (2) comprising several contact areas (3), and the first contact means (2, 4) is arranged in connection with the control means (1), and the second contact means is arranged in connection with the base (2), and at least one of said contact means (2, 4) is flexible, and the coupling means (4) is arranged to touch the contact surface (2) in one or more contact areas (3) to generate a control signal, wherein a contact area is arranged to be formed at the point of contact between the base and the coupling means. The invention also relates to a method for forming a control signal by a multidirectional control switch, as well as to a program implementing the method, and a software product.

21 Claims, 5 Drawing Sheets

DIGITAL MULTIDIRECTIONAL CONTROL SWITCH

CROSS-REFERENCE TO RELATED APPLICATIONS

This application claims priority under 35 USC §119 to Finnish Patent Application No. 20035099 filed on Jun. 18, 2004.

FIELD OF THE INVENTION

The invention relates to a multidirectional control switch which comprises at least a control means arranged to be movable, a base, and first and second contact means connected to the control means and/or the base, one of the contact means being a coupling means. The invention also relates to a mobile station comprising at least a multidirectional control switch which comprises at least a control means arranged to be movable, a base, and first and second contact means connected to the control means and/or the base, one of the contact means being a coupling means. Furthermore, the invention relates to a method for generating a control signal by means of a multidirectional control switch which comprises at least a control means arranged to be movable, a base, and first and second contact means connected to the control means and/or the base, one of the contact means being a coupling means. Moreover, the invention relates to a program and a corresponding software product comprising a set of program commands for processing control signals generated by means of a multidirectional control switch which comprises at least a control means arranged to be movable, a base, and first and second contact means connected to the control means and/or the base, one of the contact means being a coupling means.

BACKGROUND OF THE INVENTION

In portable devices and particularly mobile phones, space utilization is a significant factor in the manufacture of the device. In spite of the space saving, however, the user of the device should be provided with a device which is as functional and reliable as possible. As the user interfaces of mobile phones become more versatile, a multidirectional control switch, such as, for example, a joystick or a navigation key, is becoming more and more significant in improving convenience in use. Consequently, in addition to reliability, convenient functionality and versatile options are required of the control switch, according to the need.

Conventional multidirectional control switches typically comprise a control means which can be tilted in different directions. Thus, by its edge, the tilted control means activates a coupling located in the respective direction, thereby generating information about the direction in which the switch has been controlled. In addition, some multidirectional control switches have the facility to press the switch directly towards the base, whereby it is possible to generate auxiliary control data. Conventionally, multidirectional control switches intended for small electronic devices are 2/3, 4/5 and 8/9-directional, and the information to be obtained from them typically contains the control direction only. For the user, however, it is convenient if the device also operated according to the strength of the pressing; for example, if the user presses the control switch more strongly, the cursor would move faster on the display.

European patent application EP 1 280 173 A2 discloses a digital control switch structure which generates, upon pressing the control switch, information about the length of the pressing in addition to the direction. In said control switch structure, the couplings connected to the circuit board structure are placed in an array of two or more concentric circles in such a way that couplings on different circles are radially aligned in each direction to be indicated. When the control switch is pressed lightly in one direction, the coupling of the first circle is activated. When the control switch is pressed more strongly, the coupling of the second circle is coupled in addition to the coupling of the first circle, indicating information about a long or strong pressing. In said control switch structure, several separate couplings are used, and moreover, it must comprise two or more concentric coupling areas, for which reason the design of the control switch is limited by the structures of the switch and the couplings. Consequently, said structure is primarily suitable for control switches with a maximum of 4/5 directions of movement.

SUMMARY OF THE INVENTION

It is the primary aim of the present invention to disclose a multidirectional control switch for an electronic device, producing digital control data without moving couplings.

To attain this purpose, the multidirectional control switch according to the invention is primarily characterized in that one of said contact means is a contact surface comprising several contact areas, and the first contact means is arranged in connection with the control means and the second contact means is arranged in connection with the base, and that at least one of said contact means is flexible, and the coupling means is arranged to touch the contact surface in one or more contact areas to generate a control signal, wherein a contact area is arranged to be formed at the contact point between the base and the coupling means.

The mobile station according to the invention is primarily characterized in that one of said contact means is a contact surface comprising several contact areas, and the first contact means is arranged in connection with the control means and the second contact means is arranged in connection with the base, and that at least one of said contact means is flexible, and the coupling means is arranged to touch the contact surface in one or more contact areas to generate a control signal, wherein a contact area is arranged to be formed at the contact point between the base and the coupling means.

The method according to the invention, in turn, is primarily characterized in that, furthermore, one of the contact means of the control switch is a contact surface comprising several contact areas, and the first contact means is arranged in connection with the control means and the second contact means is arranged in connection with the base, and that at least one of the contact means is flexible, and that the control signal is formed by touching the second contact means with the first contact means, wherein the coupling means touches the contact surface in one or more contact areas to generate a control signal, wherein a contact area is arranged to be formed at the contact point between the base and the coupling means.

The program and corresponding software product according to the invention, in turn, are primarily characterized in that, furthermore, one of the contact means of the control switch is a contact surface comprising several contact areas, and the first contact means is arranged in connection with the control means and the second contact means is arranged in connection with the base, and that at least one of the contact means is flexible, and that the control signal is formed by touching the second contact means with the first contact means, wherein the coupling means touches the contact surface in one or more contact areas to generate a control signal, wherein a contact area is arranged to be formed at the contact point between the base and the coupling means, wherein the program comprises program commands to detect the contact areas which have been touched by the coupling means, and to determine the direction data on the basis of the detected contact areas.

The other, dependent claims will present some preferred embodiments of the invention.

The basic idea of the invention is that at least one and preferably at least two adjacent control points are activated simultaneously by the flexible contact structure of the control switch, and the data obtained by the activation is used to generate data about the direction and strength of the control by the control switch. In an advantageous embodiment, the data obtained about the activation of control points is used to generate a control command to an application used in the device, according to the application.

The multidirectional control switch according to the invention comprises at least a control means, a base and a coupling means. The control means is a structure movable by the user, such as, for example, a control plate or a joystick. The position data of the control means is transferred to the flexible coupling means preferably by means of a flexible power transmission means. In a control situation, the coupling means is used to activate at least one contact, and in an advantageous embodiment, a connection is set up between at least two adjacent contacts, or control points, in the base. In an advantageous embodiment, the base is provided with several contacts which are placed around the centre of the control means on the base. Thus, according to the invention, the flexible coupling means will activate the more contacts of the base, the more strongly the control means is pressed. The contact areas are preferably conductive or capacitive.

According to an advantageous embodiment, the control switch structure does not require a contact at the centre of the control means on the base; therefore, the control switch can be designed in various shapes. In an advantageous embodiment of the invention, the control means is designed to have a spherical trajectory, whereby the movement felt by the user is pleasant.

According to the invention, in connection with generating the control signal of the multidirectional control switch, at least the activated contacts are detected, after which the direction is determined on the basis of the activated contacts, and the force on the control switch is determined on the basis of the number of activated contacts. The number of contacts will affect the number of directions to be indicated by the control switch. In an advantageous embodiment, 16 to 32 contacts are placed in an annular array.

In an advantageous embodiment, the direction data of the control signal is converted to a direction command of the control data, taking into account the allowed directions of movement in the application, and the force data of the control signal is converted to control data in a way defined in the application. Thus, the control switch can be used with various settings according to the application, wherein the movements of the control switch can be made to best comply with the capacity and requirements of the application. By changing the settings, it is possible to affect the number of directions of movement to be interpreted, such as, for example, from 2/3 to 32/33 directions, and the effect of the strength of the pressing on the control of the application.

DESCRIPTION OF THE DRAWINGS

In the following, the invention will be described in more detail with reference to the appended principle drawings, in which.

DETAILED DESCRIPTION OF THE INVENTION

For the sake of clarity, the figures only show the details required for understanding the invention. The structures and details which are not necessary for understanding the invention but which will be evident for anyone skilled in the art, have been omitted from the figures in order to emphasize the characteristics of the invention.

Figure 1:
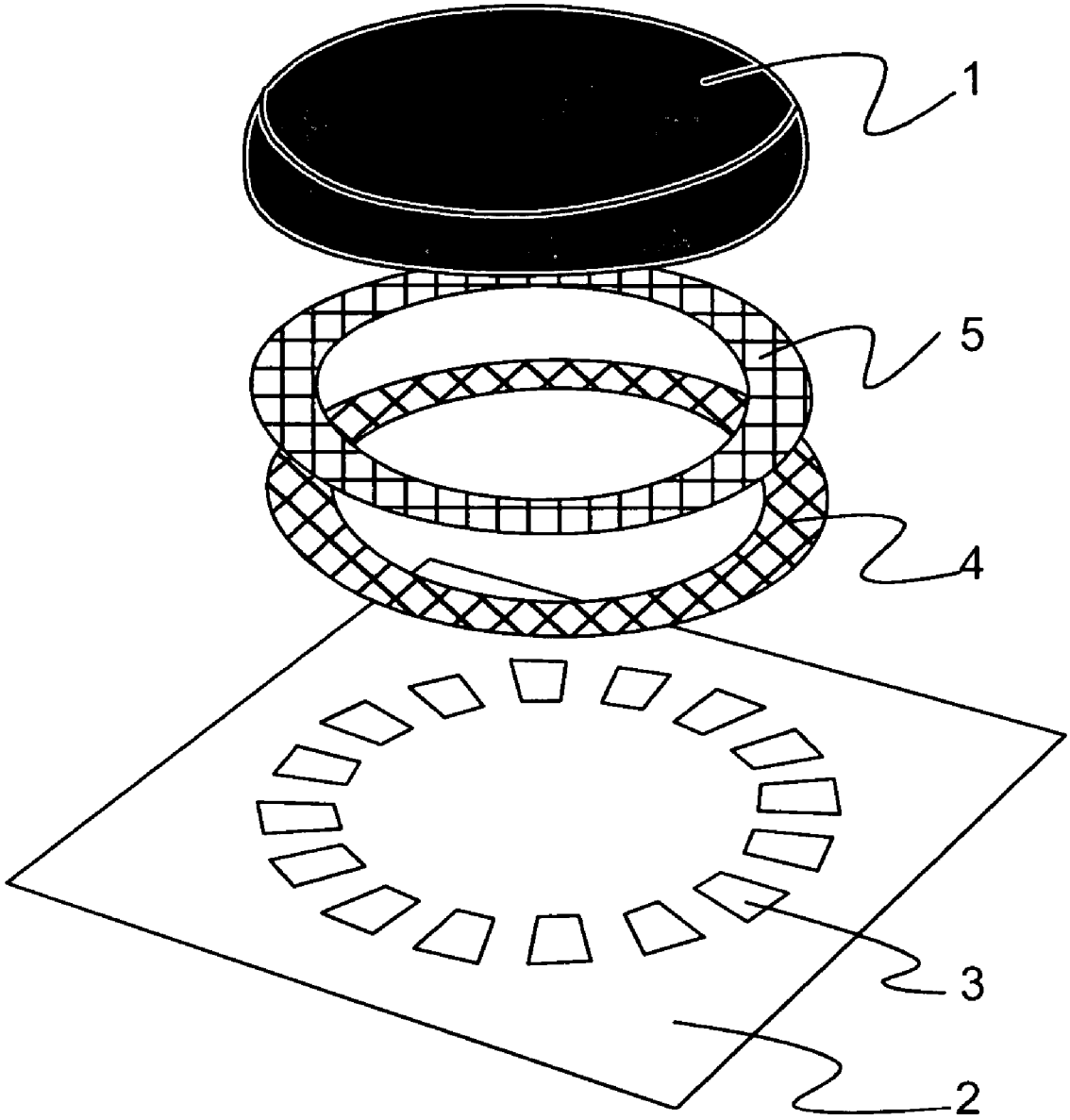
FIG. 1 shows the structure of a control switch according to the invention.

FIG. 1 shows an embodiment of a control switch according to the invention. Said control switch comprises at least a control button 1 and a base 2 with contacts 3, as well as a flexible coupling means 4 and a ring 5, which is preferably also flexible, placed between the control button and the base. In the example, the parts are separate, but it is possible to produce various embodiments of the invention by integrating the functions of several above-mentioned parts in a single part, for example by integrating the flexible coupling means 4 and the ring 5 in a single part, or by integrating both of these parts or the flexible structure in the control button 1.

Figure 2:
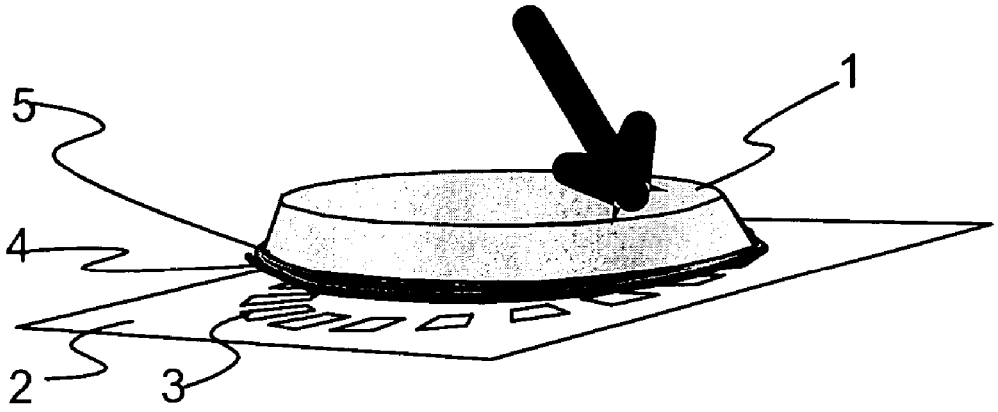
FIG. 2 shows the control switch of FIG. 1 in a control situation.

The function of the control button 1 is to transmit the control commands entered by the user to the rest of the control switch. For this reason, the control button 1 is arranged to be movable and preferably rockable in relation to the center of the control button. FIG. 2 illustrates control by the control switch in one direction. The control button 1 is thus tilted at one edge towards the base 2. At the same time, the ring 5 between the control button 1 and the base 2 presses the flexible coupling means 4 against the contacts 3 of the base in the area exposed to pressing.

In an advantageous embodiment of the invention, the coupling means 4 is a kind of a short-circuit ring which couples at least two contacts 3 of the base 2 by the effect of the pressing. By a suitable design of the coupling means 4 and the ring 5, it is possible to affect the number of contacts 3 to which the coupling means is connected at various pressing strengths.

In the preceding example, the coupling means 4 of the control switch is flexible and the base 2 is more rigid. It is also possible to design the control means of the invention in such a way that the base 2 is flexible and the coupling means 4 connected to the control button 1 is more rigid. In this case, by the effect of a control movement entered with the control button, the coupling means 4 presses the base 2 which yields to said control movement. It is also possible to arrange the contacts 3 of the control switch either on the base 2 or in connection with the control button 1 (wherein the coupling means 4 of the above example are equipped with several contacts). However, it is often advantageous to arrange the contacts 3 on the base 2, irrespective of whether the base is flexible or rigid, because the contacts are thus placed in a substantially stationary structure, wherein it is easier to arrange the data transmission from the contacts to the rest of the device. Hereinbelow, the operation of the control switch will be exemplified with an advantageous embodiment of the control switch, in which the contacts 3 are placed on the base 2 and the coupling means 4 is flexible. The following examples of said embodiment will also illustrate the operation of the other embodiments of the invention in principle, although the functions of the different embodiments may have slight differences which are, however, evident for anyone skilled in the art.

Figure 3:
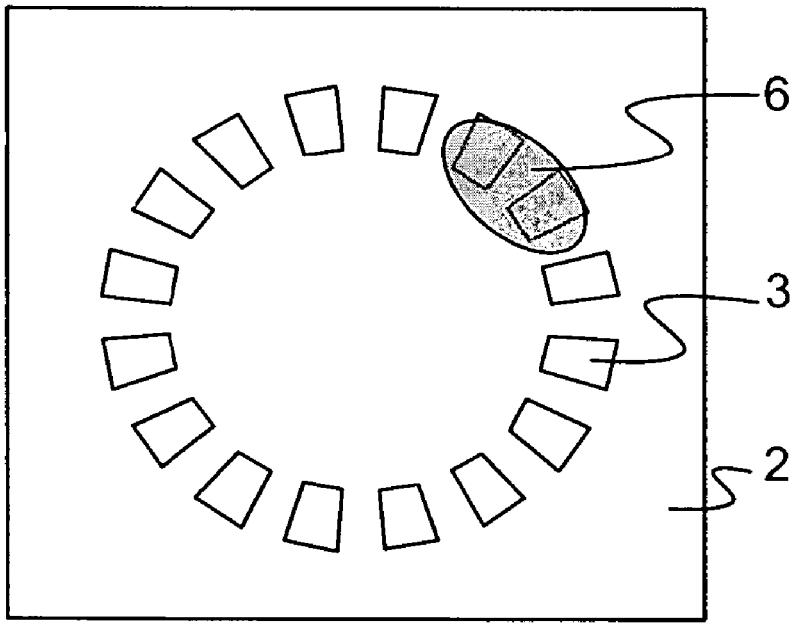
FIG. 3 shows the coupling in the situation of FIG. 2, FIGS. 4*a* to 4*d* show some coupling situations of the control switch.

FIG. 3 shows, in a principle view, the activation area 6 between the coupling means 4 and the contacts 3 of the base 2, produced by a pressing exposed by the user on the control button 1 and shown as a dashed zone in FIG. 3. The range of the area of the flexible coupling means 4, to which the pressing is transmitted from the ring 5, depends on the strength of the pressing by the user. The stronger the pressing, the more the preferably flexible structure 5 will yield, and the larger the area of the coupling means 4 exposed to the pressing. Consequently, the number of contacts 3 of the base 2 activated by the coupling means 4 will depend on the strength of the pressing by the user. The stronger the pressing, the greater the number of contacts 3 to be activated. In one embodiment of the invention, in which the contacts 3 are placed in a circular array, the coupling means 4 activates, with a weak pressing, two adjacent contacts, and the number of directions of movement to be indicated does not exceed the number of contacts on the circumference; in other words, for example, with 16 contacts, the control switch can be used to indicate 16 different directions.

By software, the number of activated contacts 3 of the base 2 can be used to generate a digital control signal. In an advantageous embodiment, the direction data can be formed by the average of the direction values of the activated contacts 3. The number of activated contacts 3, in turn, is used to determine the strength of the pressing; that is, the greater the number of activated contacts, the stronger the pressing. The digital control signal, in turn, can be used and processed in a variety of ways, for example to generate, by software, control data of certain directions only or control data of pseudo-analog type from the control signal of the multidirectional control switch. Some embodiments of this type will be presented by means of the following examples.

In an advantageous embodiment of the invention, the control signals generated by the control switch are interpreted in a way depending on the use controlled with the control switch. For example, various software applications may comprise different allowed functional and movement directions, or different movement speeds of the cursor or the like.

Figure 4A:
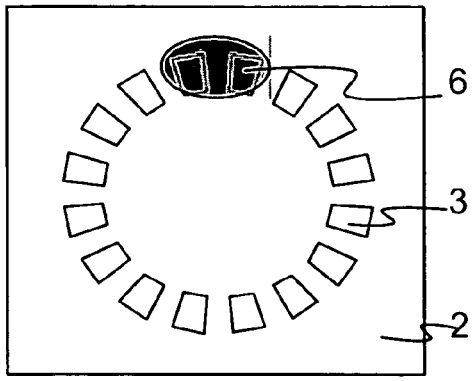
Figure 4B:
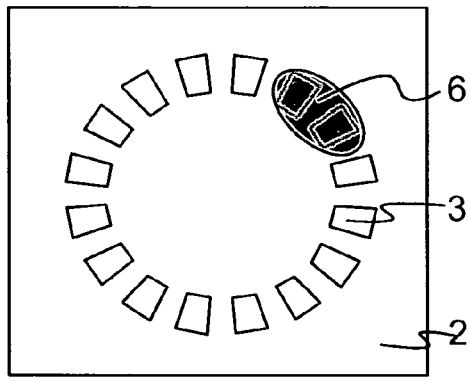
Figure 4C:
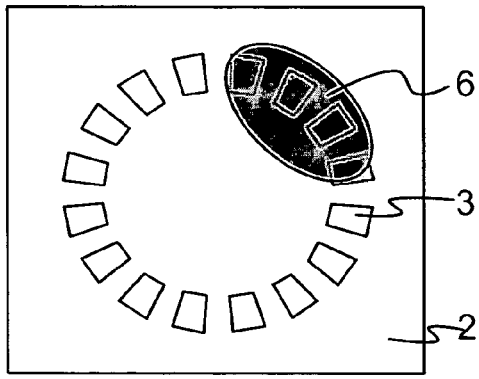
Figure 4D:
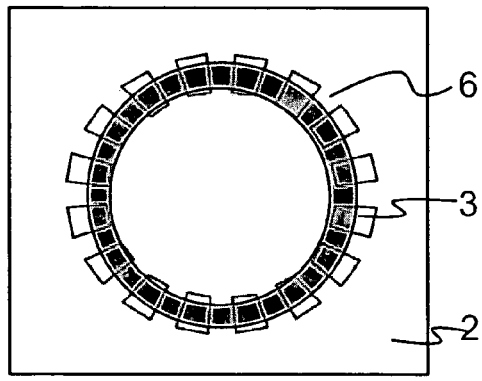

The series of FIGS. 4*a* to 4*d* illustrate the interpretation of control signals of the control switch as control commands of an application. Said application can be, for example, moving the cursor on the display, or a game played on the display. In FIG. 4*a*, the activation area 6 is in the upper part of the base 2 where two contacts 3 are activated, wherein a command to move the object slowly up is generated for the application. In FIG. 4*b*, in turn, the activation area 6 comprising two activated contacts 3 is slightly sloping upwards (in so-called one o'clock position), wherein a command to move the object slowly up and to the right (i.e. to one o'clock) is generated. In FIG. 4*c*, the activation area 6 comprises four activated contacts 3, and their average direction is at one o'clock. Thus, a command is generated to move the object fast to one o'clock. In FIG. 4*d*, all the contacts 3 (or at least almost all in a practical application) are activated, wherein a command is generated to pick up the object. Naturally, only one example has been described above to control an application, and various control commands can be generated from the control signals, depending on the application. For example, the pick-up command could be, in some situation, a command to "select" or "delete".

Figure 5:
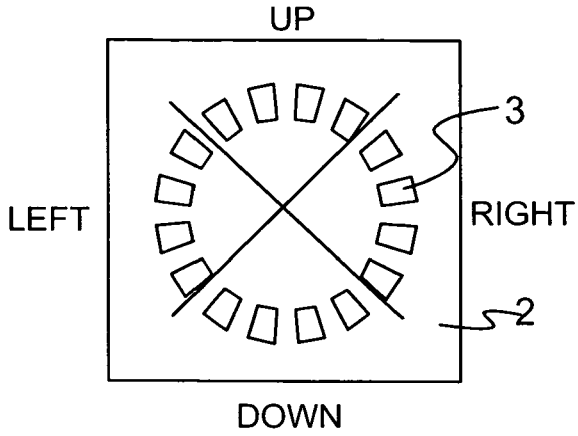
FIG. 5 shows an embodiment of interpreting control data.

FIG. 5, in turn, shows a way of interpreting the direction data of control signals from the control switch so that the user can easily control the application. In the example, it is assumed that the application comprises four allowed directions of movements, namely up, down, right and left. In this case, pressings effective on any of the sectors shown in the figure (UP, DOWN, LEFT, RIGHT) generate a control command in the nominal direction of the respective sector. Consequently, the user does not need to give a precise and accurate control movement by the control button 1, as in a conventional 4/5-directional control switch, but all the control movements effective on the sector are allowed and interpreted to refer to the nominal control direction of the respective sector.

This interpreting of the control commands by software in a situation-specific way according to the invention makes it possible to use a single control switch for utilizing a number of different applications in an effective way. Thus, for example, some of the applications may only have two allowed directions of movement, and some, for example, 16 directions of movement. The number of directions of movement is only limited by the number of contacts 3 in the control switch, wherein, for example, in the case of 200 contacts, there may also be preferably 200 different directions of movement. Also, the strength of the pressing can be interpreted differently in different applications; for example, a strong pressing of the control button 1 may be used to produce a fast progression or a jump to another location.

Figure 6A:
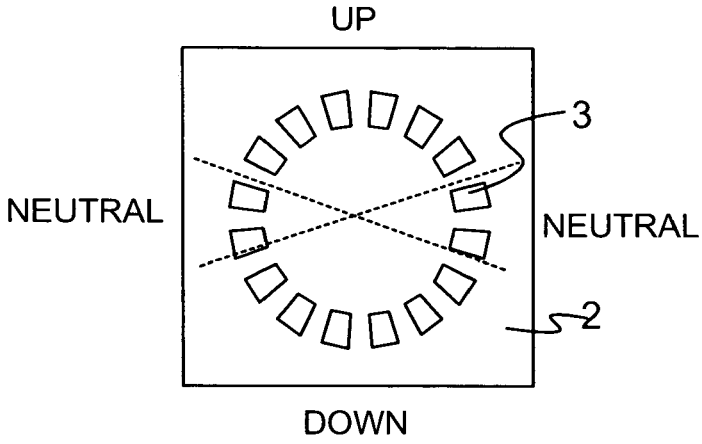
FIG. 6*a* shows an embodiment of interpreting control data in a menu application.
Figure 6B:
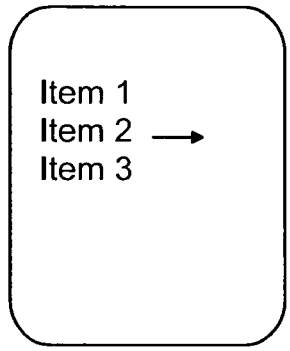
FIG. 6*b* shows the menu view of FIG. 6*a*.
Figure 7A:
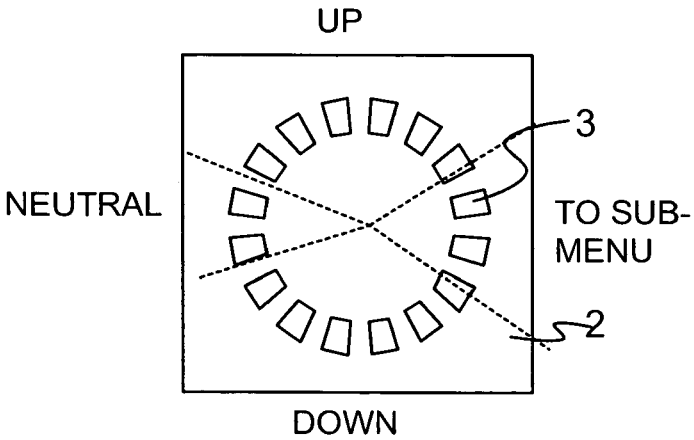
FIG. 7*a* shows another embodiment of interpreting control data in a menu application.
Figure 7B:
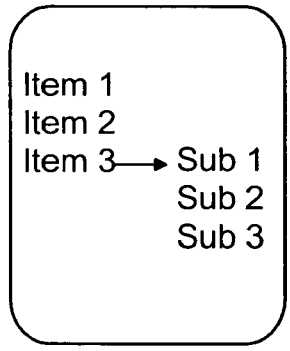
FIG. 7*b* shows the menu view of FIG. 7*a*, FIGS. 8 and 9 show some embodiments for placing the contacts.

Within the same application, it is also possible to interpret the commands of the control switch differently in different parts of the application. For example, FIGS. 6*a*, 6*b*, 7*a* and 7*b* show an example of the menu application of a mobile station. In FIG. 6*b*, the cursor has two allowed directions of movement (up and down) in the menu, wherein the control signals of the control switch are interpreted as control commands as shown in FIG. 6*a*. To improve convenience in use, in the example, a neutral area is formed between the allowed directions of movement (control movements to the right and to the left), in which control movements do not cause any function. FIG. 7*b* shows a situation in which the cursor has been moved to such a point in the menu, Item 3, where there is a possibility to move on to a submenu, Sub 1. Thus, in the interpretation of the control commands, the logics of FIG. 7*a* is applied, wherein control movements to the right are interpreted as moving on to the submenu.

Figure 8:
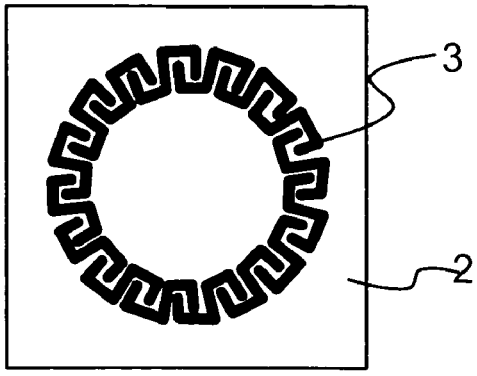
Figure 9:
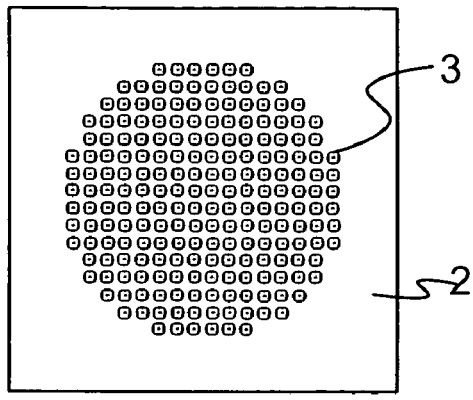

In the above description of the function of an advantageous embodiment of the invention, the structure of the control switch of FIG. 1 has been used as an example. However, it is possible to form the control switch according to the invention in a variety of ways. For example, the contacts 3 of the base 2 of the control switch can be arranged in a variety of ways, such as, for example, in the way shown in FIG. 8. In some applications, contacts 3 arranged in this way yield better sensitivity and fuzziness. Primarily, by using more contacts 3 in the contact circle of the base 2, it is possible to increase the sensitivity and resolution of the control switch. In FIG. 8 and in the preceding examples, the contacts 3 on the base 2 of the control switch have been placed in an annular array in a narrow zone. This arrangement is very advantageous, making it possible to implement the control switch mechanically in a variety of ways. However, it is possible, according to the invention, to form the control data by using a base 2 on which the contacts 3 are also placed elsewhere than in the narrow zone presented above. For example, the contact area can be a pixel type area as shown in FIG. 9. In addition to a conductive contact structure, the control data can be generated by other types of structures, such as, for example, a capacitive contact plate. In the case of different structures, however, the special features set by the various structures, such as the feedback routes, must be taken into account in the structures of the device.

Figure 10:
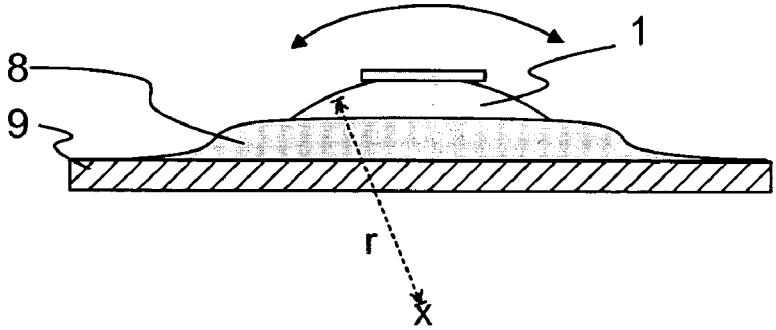
FIG. 10 shows an embodiment of the control switch in a side view.
Figure 11:
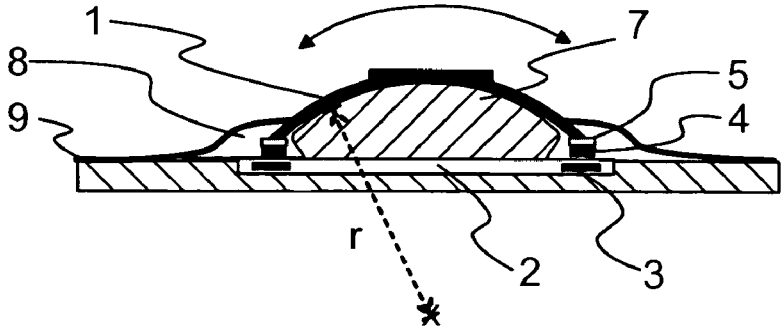
FIG. 11 shows the control switch of FIG. 10 in a cross-sectional view.

FIG. 1 shows a control switch in which the control button 1 is rockable in several directions. This structure is advantageous in small portable electronic devices, such as mobile stations, because it requires little space. In some applications, it is convenient for the user that the control button 1 is implemented so that its trajectory complies with the trajectory of a conventional joystick. One advantageous embodiment is shown in FIGS. 10 and 11. In this embodiment, the control button 1 is arranged to move in relation to a spherical surface 7. The radius of curvature r of the spherical surface 7 is selected to be such that it gives the user a pleasant feel of control. Typically, the radius of curvature r must be relatively great, for which reason conventional joysticks based on a ball joint are difficult to be placed in small devices. The structure of FIG. 11, in turn, can be implemented as a flat version, whereby it can be placed on a base 9 or in a device which is thinner than the radius r of the spherical surface 7 to which the control button 1 conforms. Also, the structure of its control switch can be easily made as tight as possible, for example by a flexible collar structure 8 which is used as a sealing and as a means for centering the control button, wherein the reliability of the control switch is better than that of "open" devices, particularly in portable devices.

As presented above, the control button 1 can be implemented in a variety of ways. In addition to the plate-like and peg-like shapes presented above, the control button 1 can be made rod-shaped. Furthermore, the control button 1 can be provided with other buttons to implement various control functions not described above, or to replace some of the above-mentioned functions. For example, an auxiliary button for the control button 1 can be used to implement the above-described "pick up" command, wherein the structure of the control switch does not need to allow simultaneous activation of all the contacts 3.

By combining, in various ways, the modes and structures presented in connection with the different embodiments of the invention presented above, it is possible to produce various embodiments of the invention in accordance with the spirit of the invention. Therefore, the above-presented examples must not be interpreted as restrictive to the invention, but the embodiments of the invention can be freely varied within the scope of the inventive features presented in the claims hereinbelow.

The invention claimed is:

1. A multidirectional control switch, which comprises at least a control means arranged to be movable, a base, and a first and a second contact means, and one of the contact means being a coupling means, wherein one of said contact means is a contact surface comprising several contact areas, the first contact means is arranged in connection with the control means, and the second contact means is arranged in connection with the base, at least one of said contact means is flexible, the coupling means is arranged to touch the contact surface in one or more contact areas to generate a control signal, wherein a contact area is arranged to be formed at the contact point between the base and the coupling means.

2. The control switch according to claim 1, wherein the surface area of the contact area between the base and the coupling means is arranged to change by the effect of a control movement effective on the control means.

3. The control switch according to claim 1, wherein the contact areas are placed on the contact surface in a circular array, the centre of the circle being substantially at the centre of the control means.

4. The control switch according to claim 1, wherein the control means is arranged to move along a trajectory complying with a spherical surface whose effective centre of revolution is located outside the control switch.

5. The control switch according to claim 1, wherein the contact areas are electroconductive or capacitive.

6. The control switch according to claim 1, wherein the coupling means is at least partly electroconductive.

7. A mobile station comprising at least a multidirectional control switch, which comprises at least a control means arranged to be movable, a base, and a first and a second contact means, and one of the contact means being a coupling means, wherein one of said contact means is a contact surface comprising several contact areas, the first contact means is arranged in connection with the control means, and the second contact means is arranged in connection with the base, at least one of said contact means is flexible, the coupling means is arranged to touch the contact surface in one or more contact areas to generate a control signal, wherein a contact area is arranged to be formed at the contact point between the base and the coupling means.

8. The mobile station according to claim 7, wherein the surface area of the contact area between the base and the coupling means is arranged to change by the effect of a control movement effective on the control means.

9. The mobile station according to claim 7, wherein the contact areas of the control switch are placed on the contact surface in a circular array, the centre of the circle being substantially at the centre of the control means.

10. The mobile station according to claim 7, wherein the control means of the control switch is arranged to move along a trajectory complying with a spherical surface whose effective centre of revolution is located outside the control switch.

11. A method for generating a control signal by a multidirectional control switch, which control switch comprises at least a control means arranged to be movable, a base, and a first and a second contact means, and one of the contact means being a coupling means, wherein in addition, one of said contact means of the control switch is a contact surface comprising several contact areas, the first contact means of the control switch is arranged in connection with the control means, and the second contact means is arranged in connection with the base, at least one of the contact means of the control switch is flexible, the control signal is generated by touching the second contact means with the first contact means, wherein the coupling means touches the contact surface in one or more contact areas, wherein a contact area is formed at the contact point between said contact means.

12. The method according to claim 11, wherein in connection with generating the control signal, at least those contact areas are detected, which are located in the area of touching, and the direction data is determined on the basis of the detected contact areas.

13. The method according to claim 12, wherein the control signal is converted to control data, wherein at least a set of allowed directions of movement are determined for the control data, and one direction of movement is selected from said set of allowed directions of movement as the direction of movement for the control data, on the basis of the direction data.

14. The method according to claim 13, wherein determining at least a first set of adjacent contact areas, on the basis of which the first direction of movement is selected, and determining at least a second set of adjacent contact areas, on the basis of which the second direction of movement is selected.

15. The method according to claim 14, wherein determining a neutral set of contact areas which are located between said first and second sets of contact areas, wherein when the coupling means touches the contact area of said neutral set, the generation of control data is omitted.

16. The method according to claim 11, wherein in connection with generating the control signal, at least those contact areas are detected, which are located in the area of touching, and the speed data is determined on the basis of the detected contact areas.

17. The method according to claim 11, wherein the number of coupling areas to be touched by the coupling means will depend on the force effective on the control means.

18. A program comprising a set of program commands for processing control signals generated by a multidirectional control switch, which control switch comprises at least a control means arranged to be movable, a base, and a first and a second contact means, and one of the contact means being a coupling means, wherein in addition, one of said contact means of the control switch is a contact surface comprising several contact areas, the first contact means of the control switch is arranged in connection with the control means, and the second contact means is arranged in connection with the base, at least one of the contact means of the control switch is flexible, the control signal is generated by touching the second contact means with the first contact means, wherein the coupling means touches the contact surface in one or more contact areas, wherein a contact area is formed at the contact point between said contact means, wherein the program comprises program commands for detecting those contact areas which have been touched by the coupling means, and for determining direction data on the basis of the detected contact areas.

19. Program according to claim 18, wherein the program comprises program commands for determining a set of allowed directions of movement of the control data, and for selecting the direction of movement of the control data from said set of allowed directions of movement, on the basis of the direction data.

20. Program according to claim 18, wherein the program comprises program commands for detecting the contact areas located in the area of touching, and for determining the speed data on the basis of the detected contact areas.

21. A software product for storing the program according to claim 18.

* * * * *